US006463987B1

(12) United States Patent
Nevins

(10) Patent No.: US 6,463,987 B1
(45) Date of Patent: Oct. 15, 2002

(54) WINDOW COVERING SYSTEM AND METHOD FOR CONTROLLING WINDOW COVERINGS

(76) Inventor: Robert L. Nevins, 5065 Rte. 28A, Boiceville, NY (US) 12412

( * ) Notice: Subject to any disclaimer, the term of this patent is extended or adjusted under 35 U.S.C. 154(b) by 0 days.

(21) Appl. No.: 09/886,915

(22) Filed: Jun. 21, 2001

(51) Int. Cl.[7] ..... E06B 9/30
(52) U.S. Cl. ..... 160/178.1 R; 160/173 R
(58) Field of Search ..... 160/168.1 R, 173 R, 160/173 V, 168.1 V, 178.1 R, 178.1 V, 189, 190; 16/194, 210, 211, 212, 214

(56) References Cited

U.S. PATENT DOCUMENTS

| | | | | |
|---|---|---|---|---|
| 4,271,893 A | | 6/1981 | McCluskey | 160/178 |
| 4,316,493 A | | 2/1982 | Arena | 160/168 |
| 4,887,658 A | * | 12/1989 | Cloutier | |
| 5,125,447 A | | 6/1992 | Suggs | 160/344 |
| 5,354,011 A | | 10/1994 | Rozon | 242/402 |
| 5,450,891 A | | 9/1995 | Benthin | 160/323 |
| 5,472,035 A | | 12/1995 | Biba et al. | 160/168.1 |
| 5,476,132 A | | 12/1995 | Jacobson | 160/168.1 |
| 5,507,374 A | | 4/1996 | Rude | 192/8 |
| 5,518,198 A | | 5/1996 | Chumbley et al. | 242/405.1 |
| 5,553,653 A | * | 9/1996 | Rozon | |
| 5,562,140 A | | 10/1996 | Biba | 160/178.1 |
| 5,577,543 A | | 11/1996 | Jelic | 160/178.1 |
| 5,579,819 A | | 12/1996 | Hung et al. | 160/178.1 |
| 5,676,188 A | | 10/1997 | Cadorette | 160/178.1 |
| 5,709,258 A | * | 1/1998 | Coccoluto | |
| 5,762,281 A | | 6/1998 | Foley | 242/376 |
| 5,906,233 A | | 5/1999 | May | 160/178.1 |

* cited by examiner

*Primary Examiner*—Blair M. Johnson

(57) ABSTRACT

The present invention provides a system for controlling a window covering device comprising a body adapted for mounting adjacent to a window and a weight. The body includes a channel and an entry aperture. The entry aperture is adapted for entry of at least one cord of the window covering device into the channel and the weight is adapted for movable attachment to the at least one cord.

19 Claims, 12 Drawing Sheets

WINDOW COVERING SYSTEM AND METHOD FOR CONTROLLING WINDOW COVERINGS

TECHNICAL FIELD

This invention relates generally to window covering devices and more particularly to a system and method for controlling window covering devices.

BACKGROUND OF THE INVENTION

Cords for controlling window covering devices, for example blinds or curtains, have been implicated in many deaths particularly those of infants and small children. Many window covering devices manufactured prior to 1995 utilized a looped control cord 10 to raise, lower, and otherwise control the window covering devices, as illustrated in FIG. 1. Subsequently, many window covering devices have been manufactured utilizing two separate control cords 20 to control different aspects of the window coverings, for example, the raising and/or lowering thereof These systems include a tassel on an end of each cord, as illustrated in FIG. 2, to reduce the likelihood of the control cords becoming entangled and forming a noose in which children might become entangled.

Despite this modification, many deaths have resulted from children becoming entangled and hanging themselves in window covering control cords 20 of both the looped variety and the double corded tassel variety. Children also have hanged themselves in other cords 30 of these window covering devices which hold the slats or vanes 33 thereof, and which are connected to the window covering control cords, as depicted in FIG. 3.

Therefore, there is a need for improved systems and methods for controlling window covering systems, particularly to improve the safety of control cords of such systems.

SUMMARY OF THE INVENTION

The present invention provides, in a first aspect, a system for controlling a window covering device wherein the system comprises a body adapted for mounting adjacent to a window and a weight. The body includes a channel and an entry aperture. The entry aperture is adapted for entry of at least one cord of the window covering device into the channel. The weight is adapted for movable attachment to the at least one cord.

The present invention provides, in a second aspect, a system for controlling a window covering device wherein the system comprises a body adapted for mounting adjacent to a window. The body includes a channel, an entry aperture, an exit aperture, and a retaining member. The entry aperture is adapted for entry of at least one cord of the window covering device into the channel. The exit aperture is adapted for exit of the at least one cord, and the exit aperture is different from the entry aperture. The retaining member is adapted to receive the at least one cord.

The present invention provides, in a third aspect, a method for controlling a window covering device. The method includes providing a body adapted for mounting adjacent to a window and providing a weight. The body includes a channel and an entry aperture. The entry aperture is adapted for entry of at least one cord of the window covering device into the channel and the weight is adapted for movable attachment to the at least one cord.

The present invention provides, in a fourth aspect, a method for controlling a window covering device comprising providing a body adapted for mounting adjacent to a window. The body includes a channel, an entry aperture, an exit aperture, and a retaining member. The entry aperture is adapted for entry of at least one cord of the window covering device into the channel. The exit aperture is adapted for exit of the at least one cord, and the exit aperture is different from the entry aperture. The retaining member is adapted to receive the at least one cord.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of preferred embodiments taken in conjunction with the accompanying drawings in which:

DETAILED DESCRIPTION

Figure 1:
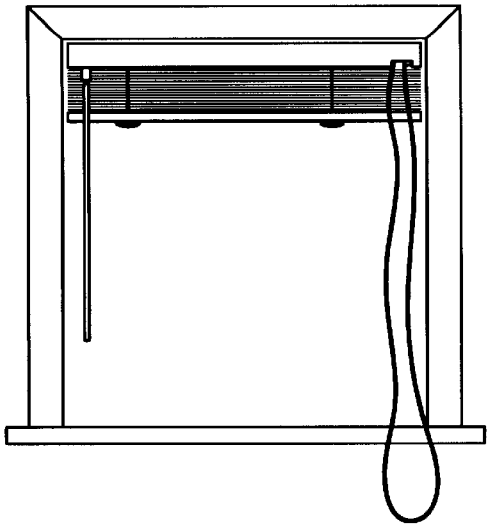
FIG. 1 PRIOR ART
FIG. 1 is a front elevational view of a window covering device having a continuous loop for a control cord.
Figure 2:
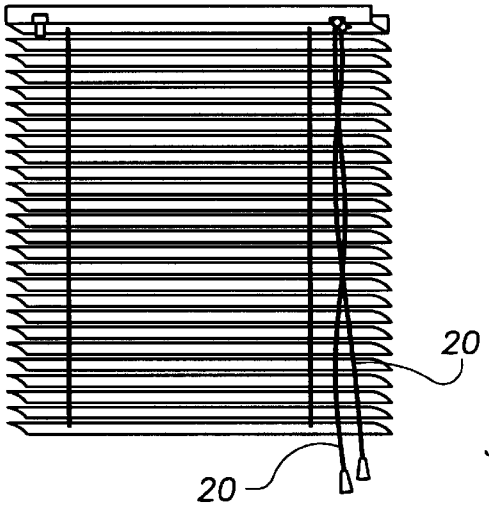
FIG. 2 PRIOR ART
FIG. 2 is a front elevational view of a window covering device having two control cords with tasseled ends.
Figure 3:
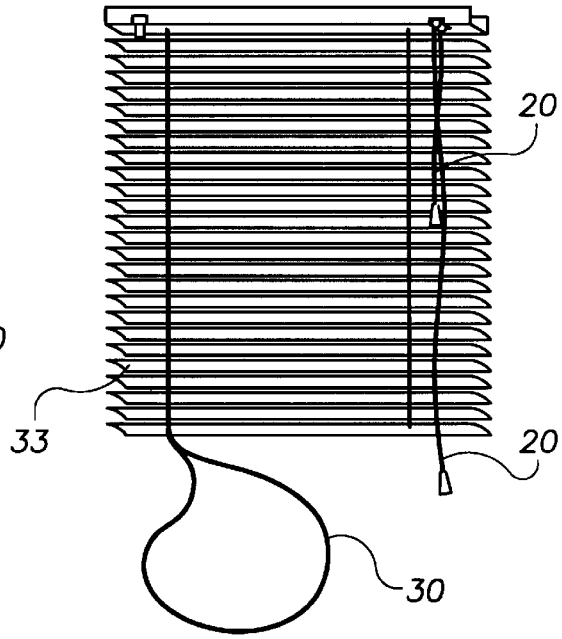
FIG. 3 PRIOR ART
FIG. 3 is a front elevational view of the window covering device of FIG. 2 showing a portion of a cord used to hold individual covering elements pulled into a loop.
Figure 4:
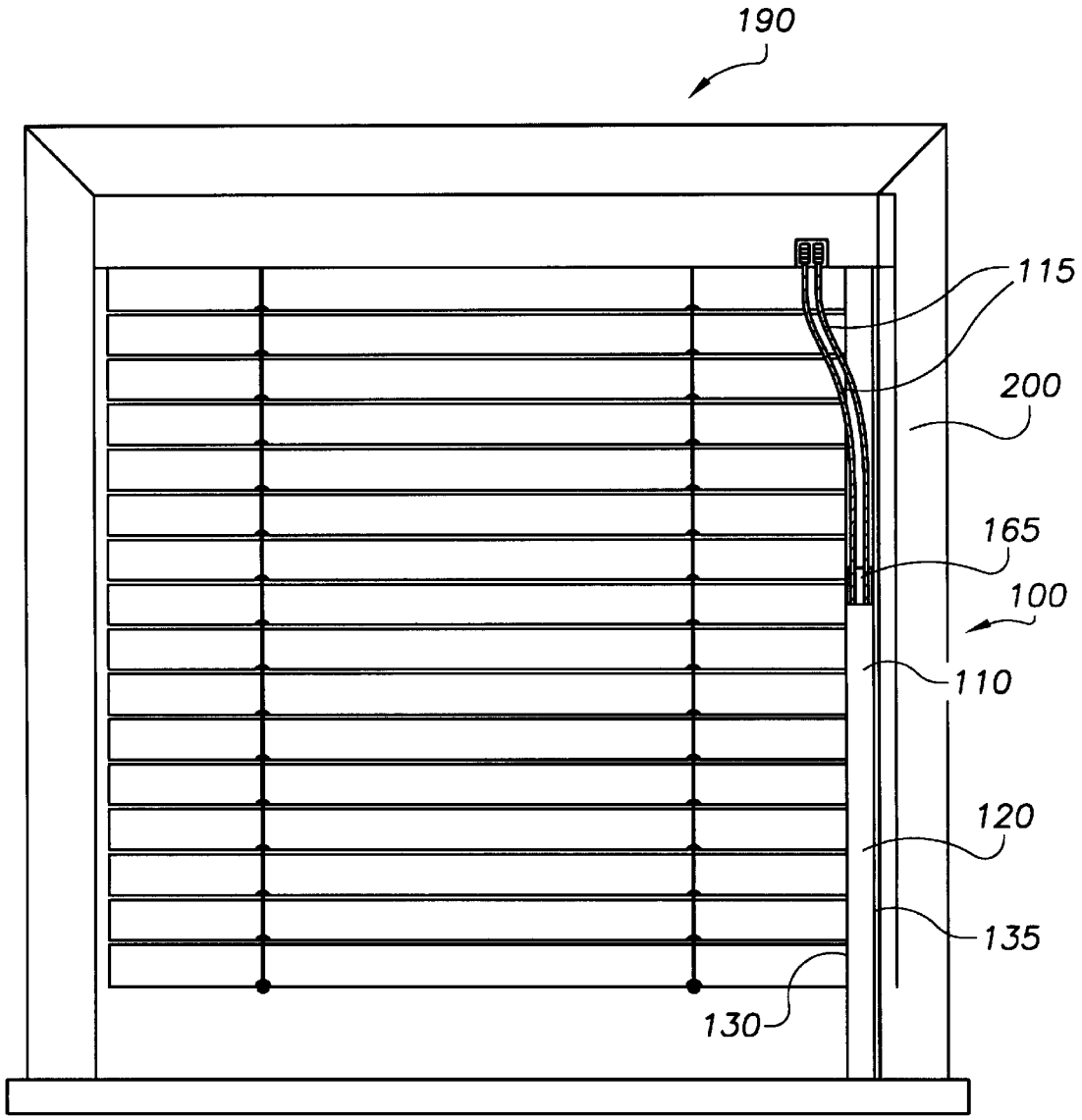
FIG. 4 is a front elevational view of a system for controlling a window covering device mounted adjacent to the window covering device, in accordance with the principles of the present invention.

In accordance with principles of present invention, examples of systems and methods for controlling window covering devices are depicted in FIGS. 4–19 and described in detail herein.

FIGS. 4–9 depict one embodiment of a system 100 for controlling a window covering device 190, for example window blinds, which includes a body portion or body 110 adapted for mounting adjacent to a window and a weight 160. Body 110 includes a channel 150 and an entry aperture 165 adapted for entry of one or more control cords 115 of window covering device 190 into channel 150. Weight 160 is adapted for movable attachment to the one or more cords 115.

Figure 9:
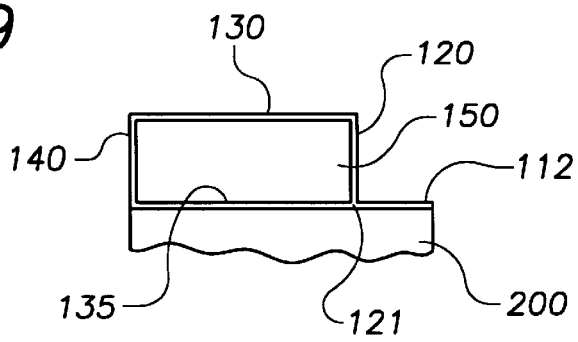
FIG. 9 is a top cross-sectional view of the system of FIG. 4.
Figure 10:
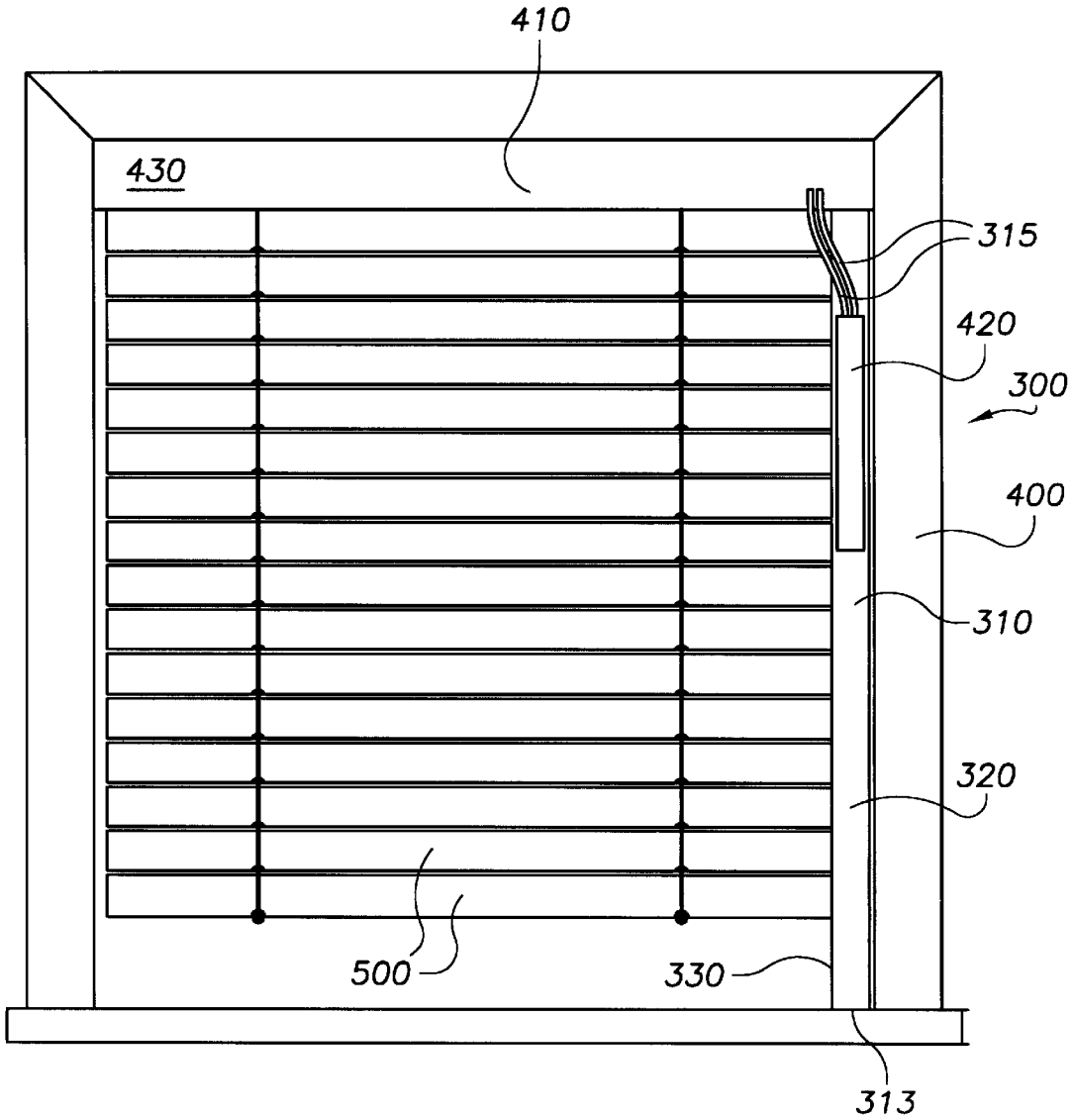
FIG. 10 is a front elevational view of another embodiment of a system for controlling a window covering in accordance with the principles of the present invention.

Body 110 includes vertically extending sides which form channel 150 and which may be mounted to a window frame 200. A front side 120 of body 110 may be mounted about parallel to a window and a left side 130 about perpendicular to front side 120. Thus, a rear side 140 is located about parallel to front side 120 and a right side 135 is located about parallel to left side 130, as best depicted in FIG. 9. Right side 135 may be attached to window frame 200 in any of a number of ways, as is known by those skilled in the art, for example, using screws, nails, or adhesive. Body 110 might be formed from any number of materials which are aesthetically suitable for mounting adjacent to a window and which may be formed in such a shape, for example a plastic or vinyl material. In one example, body 110 might be formed of an opaque material to reduce light infiltration therethrough when window covering device 190 is in a lowered position.

Body 110 may also include a mounting flange 112 connected to and parallel to right side 135. Flange 112 facilitates mounting of body 110 to window frame 200. In another example, body 110 may lack right side 135 and a channel may be formed by the remaining three sides on mounting body 110 to window frame 200. Thus, a fourth side may be formed by window frame 200 itself In this case, flange 112 might be connected to a right end 121 of front side 120.

Figure 5:
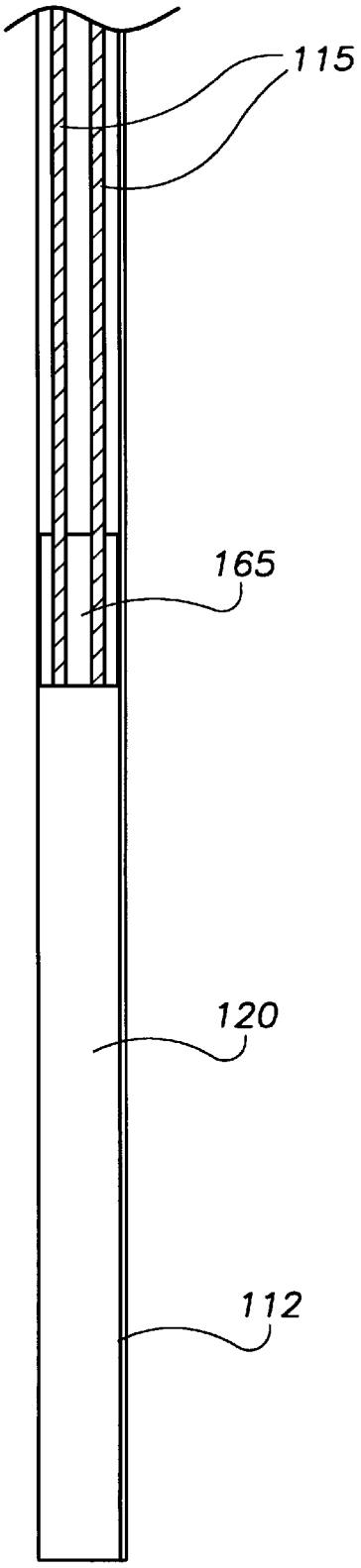
FIG. 5 is an enlarged front elevational view of the system of FIG. 4.
Figure 6:
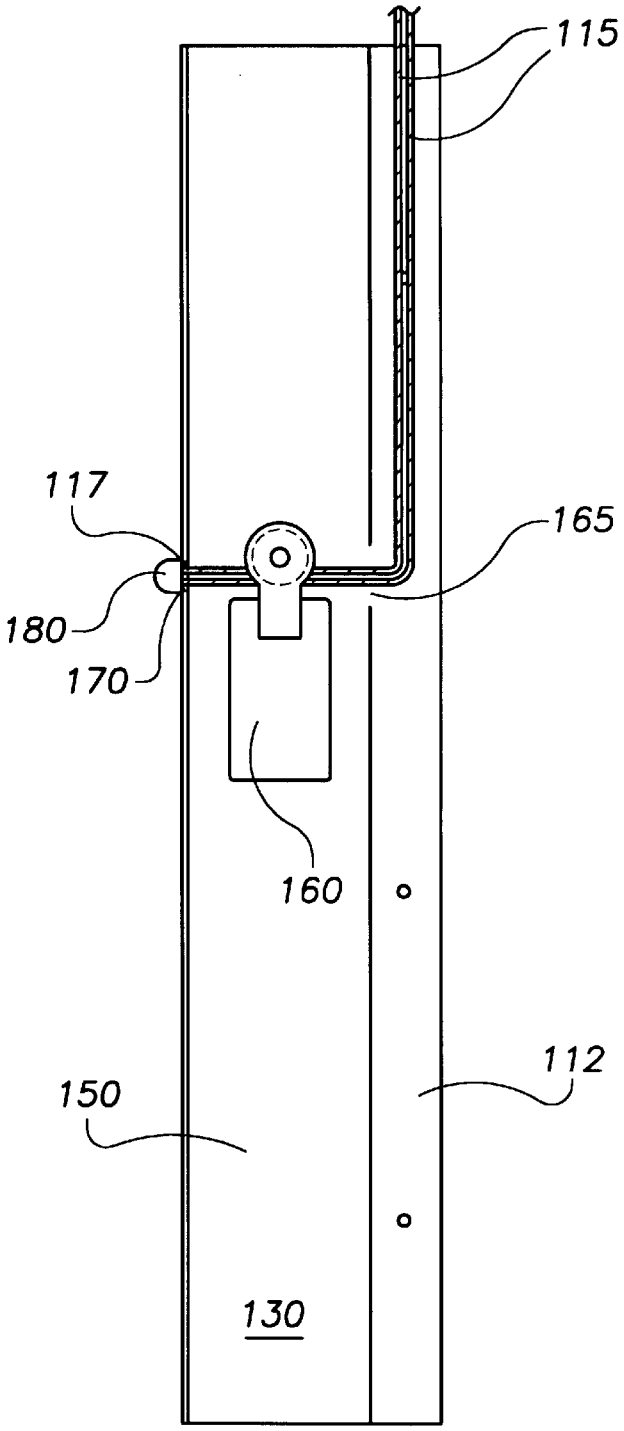
FIG. 6 is a left side cross-sectional view of the system of FIG. 4.
Figure 7:
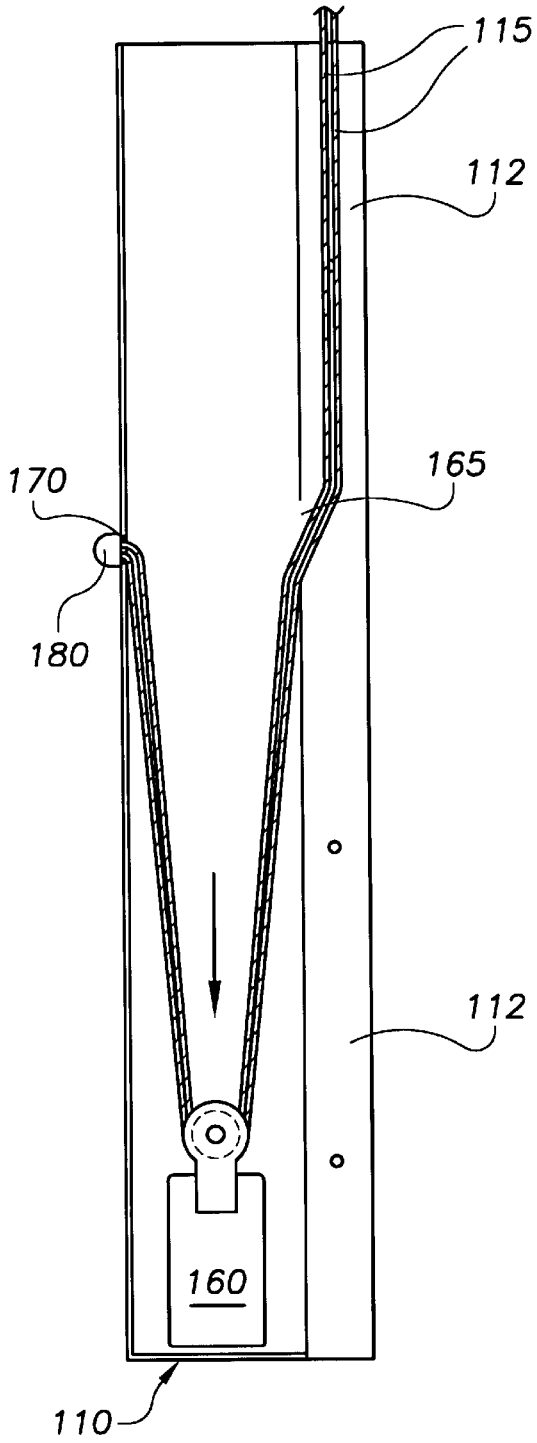
FIG. 7 is another left side cross-sectional view of the system of FIG. 4.

Body 110 also includes entry aperture 165 through which cords 115 of window covering device 190 may be inserted, as best illustrated in FIGS. 5–7. Advantageously ends 117 of cords 115 may pass through an exit aperture 170 on a rear side 140 of body 110 and may be attached to a stopper 180. Stopper 180 is sized larger than exit aperture 170 and thus prevents ends 117 from retreating into channel 150 when pressure is applied thereto. However, stopper 180 may allow ends 117 to be moved away from exit aperture 170 outside channel 150 thereby pulling a portion of cords 115 through exit aperture 170. For example, stopper 180 may be formed in the shape of a ring larger than exit aperture 170 and might be made of a plastic, rubber, or other suitable material.

A length of cords 115 might be adjusted by attaching ends 117 to stopper 180 in any of a number of ways, for example, via tying ends to stopper 180, or through an adhesive or other attachment means. An excess amount of cord 115 might be removed after attachment to stopper 180 by cutting cords 115 to remove the excess. As an alternative to stopper 180, one or more ends 117 of cords 115 may be attached to an interior portion (not shown) of body 110. Ends 117 might be attached via an adhesive or other attachment means, or ends 117 might be tied around a loop, pin, or notch attached to or integral to the interior portion. In a window covering device formed integral to system 100, ends 117 might be pre-attached to the interior portion at a proper length at its location of manufacture.

Weight 160 may be attached to cords 115 to allow weight 160 to slide along cords 115 and remain attached thereto, as illustrated in FIGS. 6 and 7. Weight 160 is adapted to reduce or prevent any slack or looseness in cords 115 by drawing any excess cord into channel 150. To draw in such slack, weight 160 has sufficient mass, and thus weight, to move downward due to gravitational force while movably connected to cords 115. The sliding of weight 160 along cords 115 as it moves downward in channel 150 brings excess cord with it into channel 150, as best depicted in FIG. 7 which shows weight 160 at its substantially bottom most position. At this position, approximately a maximum amount of cords 115 is contained in channel 150. Also, as is evident from FIG. 7, cords 118 may be "doubled back" upon themselves, that is, two approximately equal lengths of cords 115 may extend upward from weight 160 inside channel 150. For example, cords 115 may be held taut in this position when they are extended a maximum extent from a head frame 191 (FIG. 4) of window covering device 190. Weight 160 may, for example, have a dimension of 3.5 ounces and might be made of a metal and/or plastic material, for example. Also, weight 160 may be about 4.25 inches long, including a pulley or wheel portion, by about 0.875 inches wide by about 0.25 inches thick. Without the pulley, weight 160 may be about 3.5 inches long.

Figure 8:
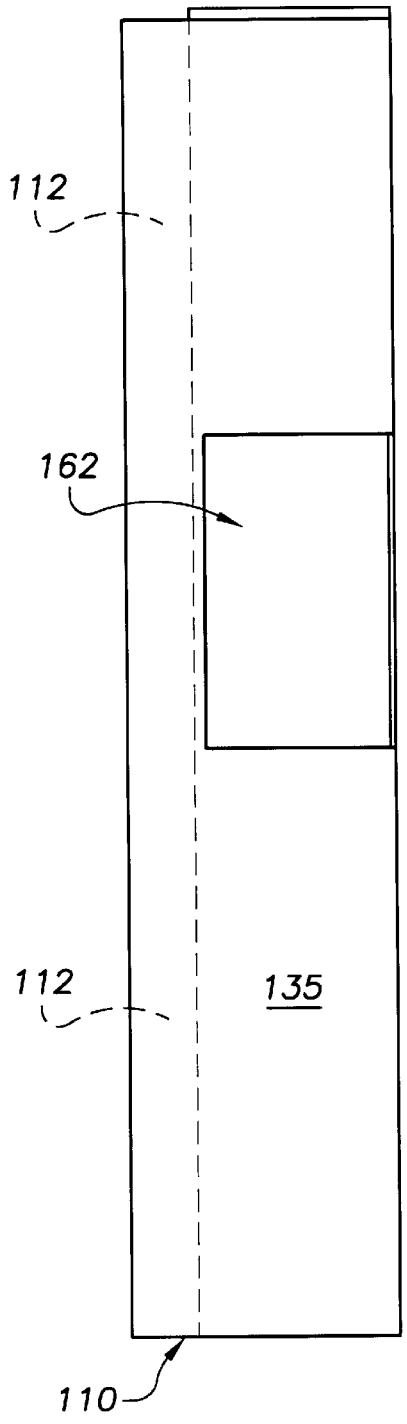
FIG. 8 is a right side elevational view of the system of FIG. 4.

Body 110 also may include a weight insertion aperture 162 in right side 135, as best illustrated in FIG. 8, to allow insertion of weight 160 and thereby attachment of weight 160 to cords 115. Weight insertion aperture 162 may be located at about the same vertical position as entry aperture 165 and exit aperture 170. Weight 160 may include a notch, a pulley, a wheel, or other means to facilitate attachment and moving of weight 160 along cords 115, as is known by those skilled in the art.

As described, it is desirable to draw in excess cord when cords 115 and window covering device 190 have been adjusted such that slack remains in cords 115. For example, in the case of window blinds, excess cord may be present when the blinds have been raised from a lower position to a higher position as a result of a user pulling on control cords 115. After the blinds have been raised, the excess cord or slack in cord 115 is drawn into channel 150 by weight 160. Cords 115, thus are maintained substantially taut adjacent to first side 120 and/or flange 112 of body 110 due to tension provided by a force of weight 160 thereon. Maintenance of cords 115 in a substantially taut state adjacent to body 110 reduces or eliminates easy access to cords 115 to anyone near window covering system 100, for example, small children. Thus, the risk of a child becoming entangled and hanging himself in cords 115 is reduced or eliminated.

Another embodiment of a system 300 for controlling window coverings, in accordance with the present invention, is depicted in FIGS. 10–14. A body portion or body 310 includes a front side 320, a left side 330, a right side 335 and a rear side 340 adapted to be mounted to a window frame 400 adjacent to a window covering device 410. Window covering device 410 might be, for example, window blinds. Front side 320, left side 330, right side 335 and rear side 340 may form a channel 350 therebetween sized to receive a weight 450.

Body 310 may also include a mounting flange 312 connected to and parallel to left side 335. Alternatively, body 310 may include front side 320, left side 330 and rear side 340, but not right side 335. In this case, channel 350 is formed by the noted sides along with window frame 400. In this case, mounting flange 312 might be attached to an end 423 of front side 320. Body 310 may be formed of any of a variety of materials, for example, a plastic material.

Body 310 may include an entry aperture 365 to allow one or more cords 315 to be inserted into channel 350. One or more ends 317 of cords 315 may be inserted through entry aperture 365 and advantageously, may be passed through an exit aperture 370 located on rear side 340 of body 310. Ends 317 may be attached to a stopper 380 outside channel 350 which may reduce or prevent ends 317 and stopper 380 from entering channel 350. Stopper 380 is sized larger than exit aperture 370 and, thus, would not prevent ends 317 and stopper 380 from being pulled away from channel 350 but would prevent stopper 380 and ends 317 from entering channel 380. Ends 317 may be attached to stopper 380 by tying ends 317 thereto, via an adhesive, or other means, as will be evident to those skilled in the art. Stopper 380 may be formed in any number of shapes and sizes, for example in a ring shape, and may be made with a variety of materials, for example a plastic material.

As an alternative to the use of stopper 180 and exit aperture 370, ends 317 of cords 315 may be attached to an interior portion (not shown) of body 310 in channel 350. Ends 317 might be attached via an adhesive or other attachment means, or ends 317 might be tied around a loop, pin, or notch attached or integral to the interior portion. Further, ends 317 might be attached through exit aperture 370 to an exterior portion of body 110 via any of various described ways. For example, ends 317 might be attached to rear side 140 via an adhesive, or ends 317 might be tied or attached to a loop, pin, or notch attached to or formed integral to rear side 140.

Figure 12:
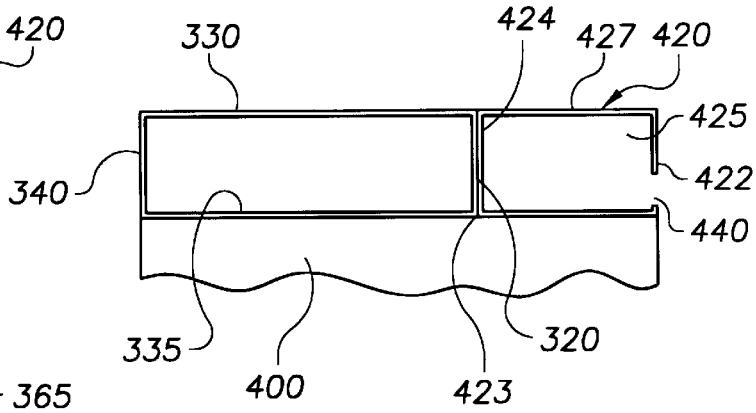
FIG. 12 is a cross-sectional top view of the system of FIG. 10.

A cord cover 420 may also be attached to front side 320 of body 310 and may be made of a variety of materials, for example, a plastic material. Cord cover 420 includes vertically extending sides, specifically a front side 422, a rear side 424, and a left side 427, as best depicted in FIG. 12. On mounting of cord cover 420 to front side 320 of body 310, mounting flange 312 may form a fourth side. The sides thus form an interior or hollow portion 425. Rear side 424 may contain a notch or aperture to allow access to entry aperture 365.

Thus, front side 422 of cord cover 420 may cover entry aperture 365 from the perspective of one standing in front of system 300 while allowing cord 315 to be inserted into entry aperture 365. Cord cover 420 may extend toward a head frame 430 of window covering 410 and toward a bottom 313 of body 310. For example, cord cover 420 may extend about two inches below entry aperture 365 and may extend about 10 inches toward a head frame 430 of window covering 410. Entry aperture 365 may advantageously be located about 62 inches from a floor. Cord cover 420 thus reduces access to cord 317 located in hollow portion 425. Also, the extension of cord cover 420 below entry aperture reduces or eliminates access to cords 315 from below entry aperture, for example, by a child. Extension of cord cover 420 toward head frame 430 further reduces or eliminate access to cords 315, since it is necessary to grasp cords 315 above a top vertical extent 429 of cord cover 420 to manipulate cords 315. Top vertical extent 429 may be about six feet (72 inches) from a floor. Cord cover 420 might be integral to body portion 310 or cord cover 420 might be connected to front side 320 of body 310 by a two sided tape, glue, adhesive, screws, nails, or other means as is known by those skilled in the art.

Figure 11:
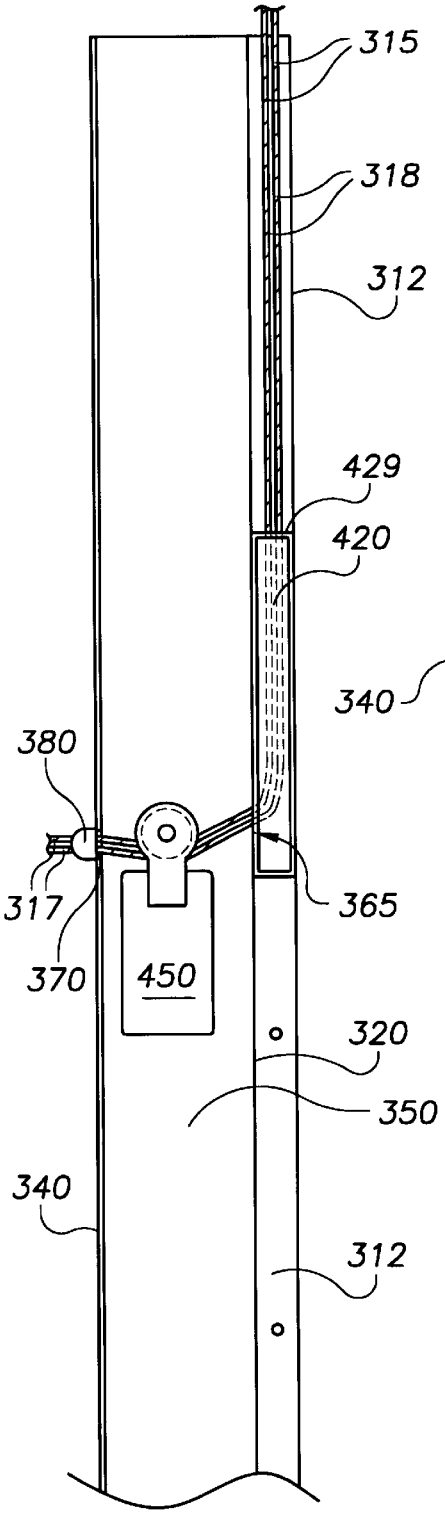
FIG. 11 is a left side cross-sectional view of the system of FIG. 10.

Cord cover 420 may further include a slot 440 advantageously located on front side 422 and substantially vertical, as depicted in FIGS. 11–12. Cords 315 may be removed from and replaced in hollow portion 425 and channel 350 through slot 440. Because slot 440 is not substantially larger than cords 315, access to cords 315 is reduced by slot 440. Thus, to manipulate cords 315 one could not easily grasp cords 115 through slot 440. Instead, it would be necessary to grasp cords 315 above top vertical extent 429. Thus, access to small children is reduced or prevented since they would not be able to grasp cords 315 through slot 440 and would not likely be able to reach above top vertical extent 429. This further reduces the ability of a child to access cords 315 and entangle himself therein.

Figure 13:
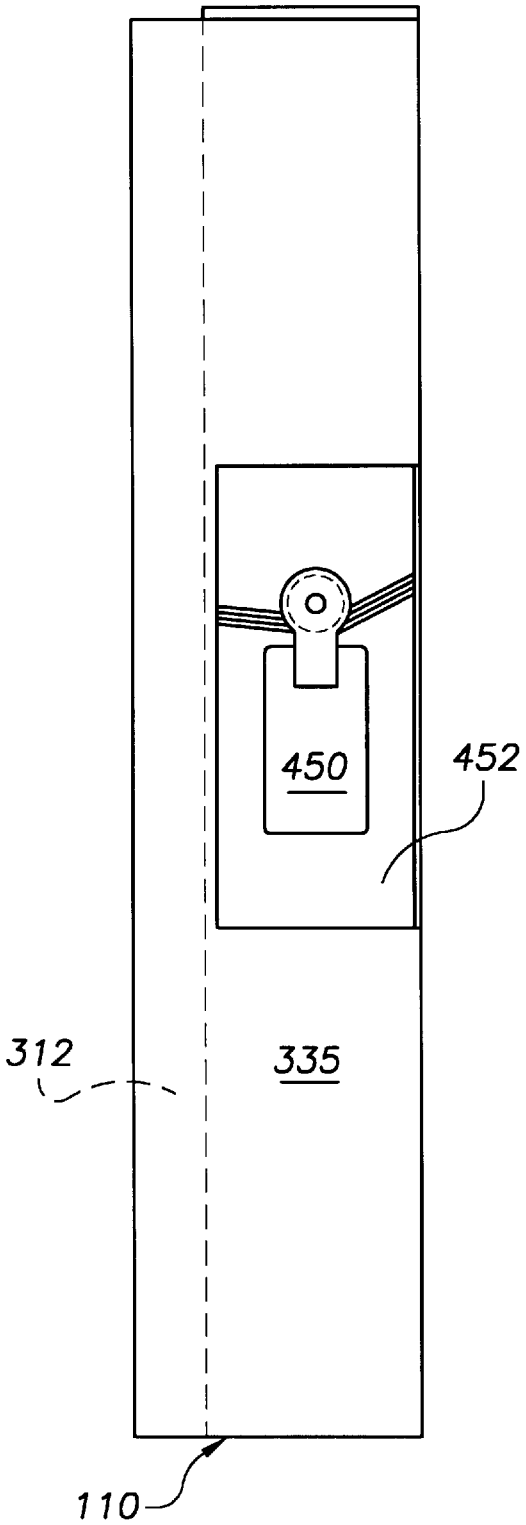
FIG. 13 is a right side elevational view of the system of FIG. 10.

Channel 350 may further include weight 450 therein movably connected to cords 315. Weight 450 serves to draw slack from cords 315 into channel 350 and to draw a portion of cords 315 located outside channel 350 into hollow portion 425 behind cord cover 420 through slot 440. Weight 450 may move along cords 315 by causing cords 315 to slide on a portion of weight 450, for example a pulley portion, as illustrated in FIG. 11. Alternatively, weight 450 may further include a wheel, slot, notch or other means to further facilitate moving of weight 450 along cords 315, as is known by those skilled in the art. Weight 450 may be inserted into channel 350 through a weight insertion aperture 452 in right side 335, as depicted in FIG. 13. By mounting right side 335 to window frame 400, access to weight insertion aperture 452 may be reduced or eliminated. This results because weight insertion aperture 452 is located on right side 335 which is no longer accessible when system 300 is mounted to window frame 400.

One example of a method for installing window covering control system 300 is described as follows with reference to FIGS. 10–13. Cords 315 are pulled to their maximum extent from head frame 430 of window covering device 410 thus raising covering portions, vanes, or slats 500 to their top most position. Cords 315 are inserted through slot 440 and through entry aperture 365 into channel 350. Weight 450 is inserted through weight insertion aperture 452 in right side 335, into channel 350. Ends 317 of cords 315 are placed through weight 450, for example a pulley or other portion thereof adapted to receive ends 317. Ends 317 are then passed through exit aperture 370 and attached to stopper 380. Body 310 is mounted, for example using screws or nails, to window frame 400 such that weight 450 is at its bottom extent in channel 350 and cords 315 are taut. A position of weight 450 may be further adjusted by adjusting a length of cords 315. This length may be adjusted by attaching cords 315 to stopper 380 at portions of cords 315 other than ends 317. For example, cords 315 might be tied to stopper 380 at a proper length and the excess cord might be removed. In this manner, portions of cords 315 which might be dangerous to small children are safely stored in channel 350.

Thus, use of window covering control system 300 with window covering device 410 may be performed as follows with reference to FIGS. 10–13. To raise or lower covering portions 500, a user may grasp a portion 318 of cords 315 above top vertical extent 429 of cord cover 420. The user may then operate window covering system 410 through manipulating portion 318. Alternatively, the user may remove cords 315 from hollow portion 425 of cord cover 420 through slot 440 and manipulate cords 315 to adjust window covering portions 500 as desired. For example, the user might pull cords 115 toward a right direction to unlock and raise or lower covering portions 500. The user might pull cords 315 in a left direction to lock covering portions 500 at a particular height or position. After releasing cords 315, a downward force due to weight 450 draws any excess cord into channel 350 through entry aperture 365. Also, if cords 315 were previously removed from hollow portion 425 of cord cover 420, the force due to weight 450 may draw excess cord also into hollow portion 425 through slot 440.

Figure 14:
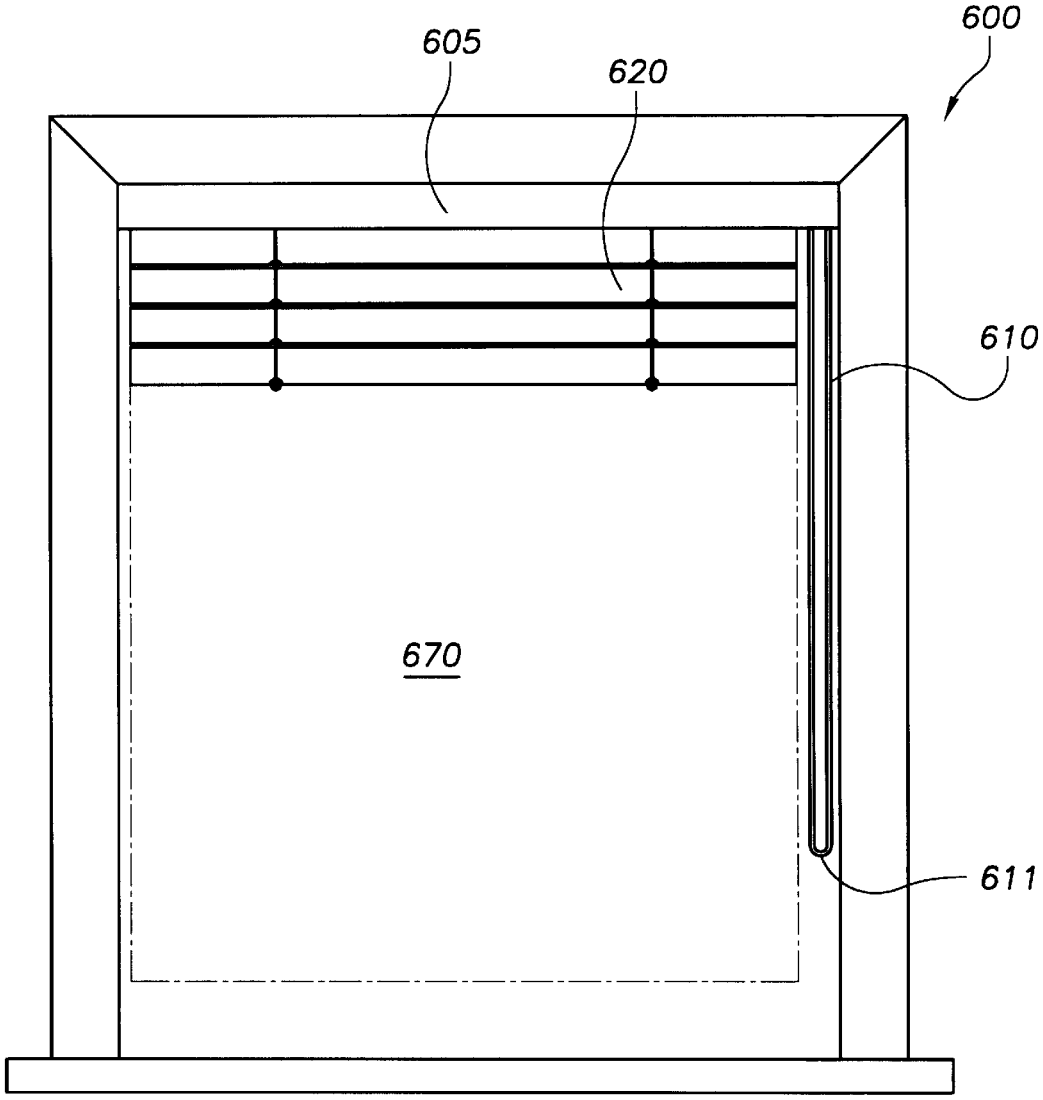
FIG. 14 is a front elevational view of a window covering device.

FIG. 14 depicts an example of a window covering device 600 having a head frame 605 and a cord 610 which must be rotated in a continuous loop to operate window covering portions 620. For example, window covering portions 620 might be blinds, drapes, or curtains which might be opened by rotating cords 610 through a clutch of head frame 605 in one direction and closed by rotating cords 610 in an opposite direction. A further embodiment of a window covering control system 700 adapted for use with window covering device 600 is depicted in FIGS. 15–18. System 700 may include a body portion 710 having an entry aperture 765, an exit aperture 770 different or separate from entry aperture 765, and a retaining member 800 to receive an end 611 of cords 610. Body portion 710 may extend substantially from head frame 605 to a bottom 651 of a window frame 650. Body portion 710 may be made of vinyl, plastic or another material suitable to be formed in such a shape and it may be opaque to reduce or eliminate infiltration of light when system 700 is in a lowered position.

Figure 15:
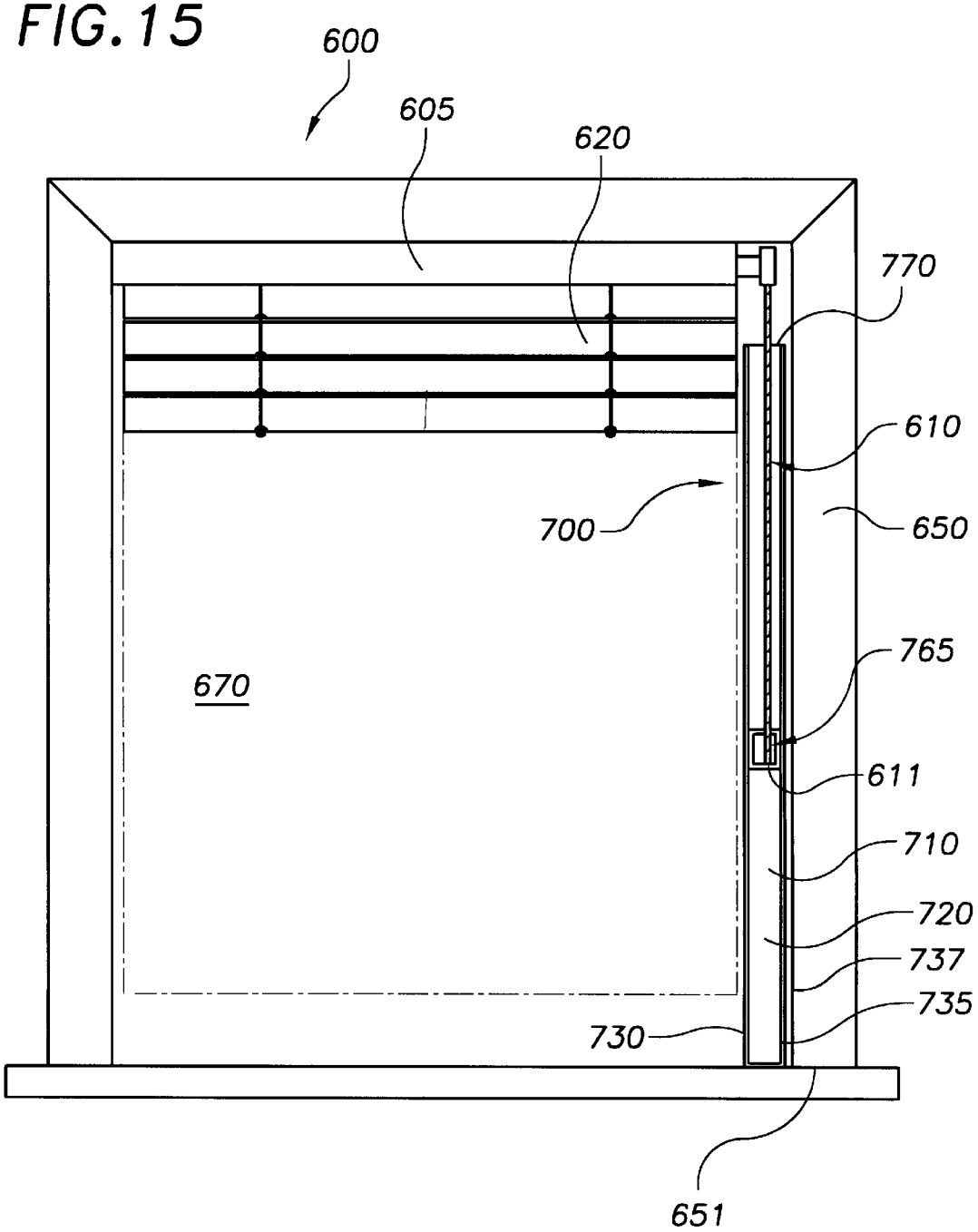
FIG. 15 is a front elevational view of a system for controlling a window covering device mounted adjacent to the window covering device in accordance with the principles of the present invention.
Figure 16:
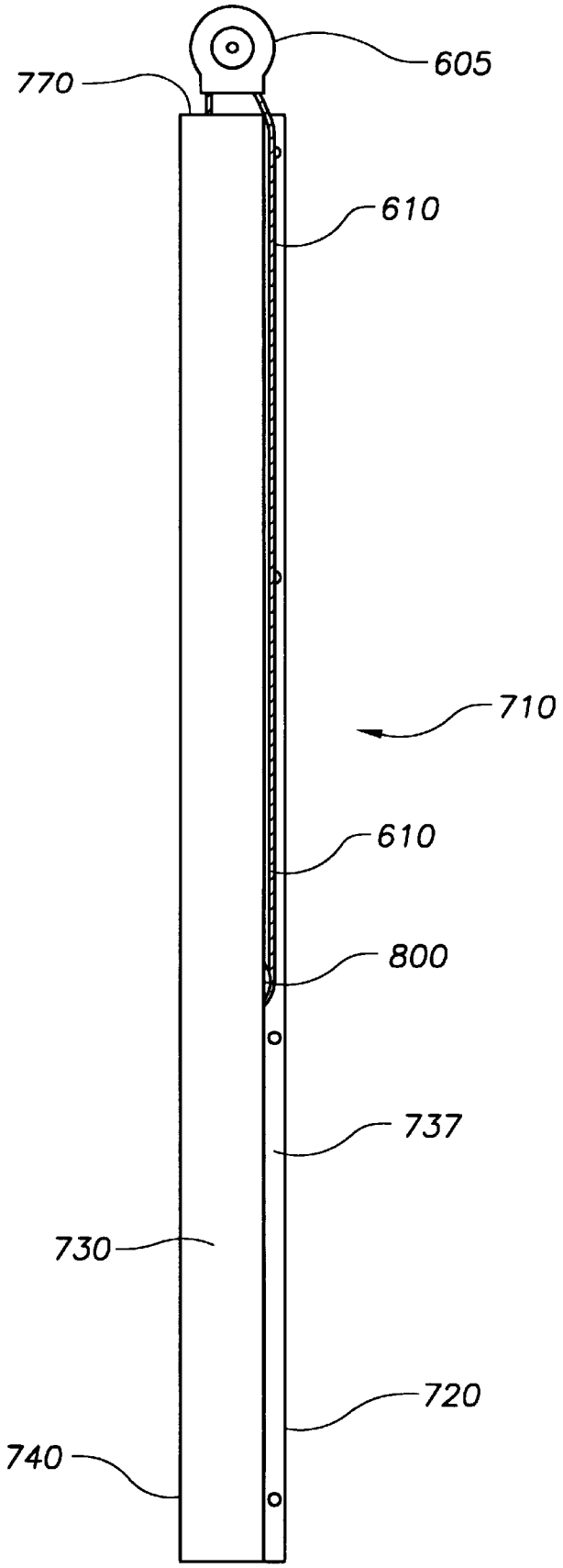
FIG. 16 is a left side elevational view of the system of FIG. 15.
Figure 17:
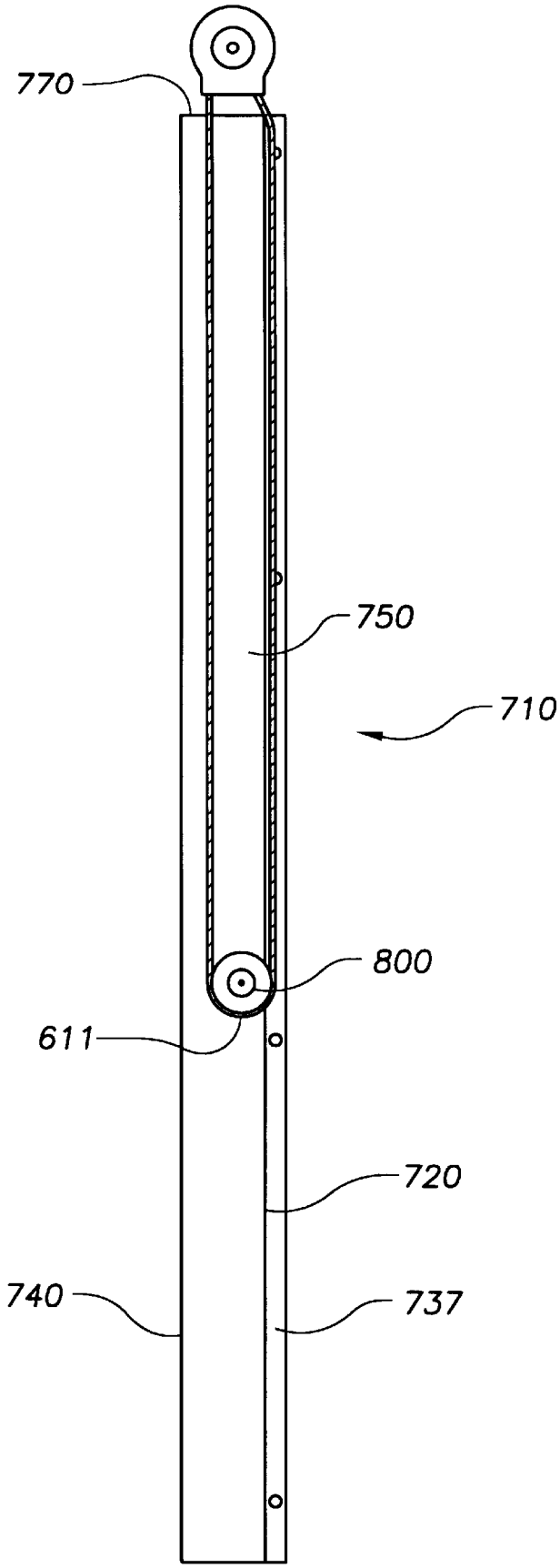
FIG. 17 is a left side cross-sectional view of the system of FIG. 15.

Also, body portion 710 includes a front side 720, a rear side 740, a left side 730, and a right side 735 (FIG. 18) which form a channel 750 (FIG. 17) between them. Body portion 710 may be mounted to window frame 650 such that front side 720 and rear side 740 are substantially parallel to a window 670. Left side 730 and right side 735, thus, are perpendicular thereto. Body portion 710 may further include a mounting flange 737 connected to and parallel to right side 735. Flange 737 and/or right side 735 of body portion 710 may be attached to window frame 650 through adhesive, nails, screws or other means, as is known by those skilled in the art Also, retaining member 800 may receive end 611 of cord 610 and may be located partially or fully in channel 750 at a location opposite from head frame 605, as depicted in FIGS. 15–17. Advantageously, retaining member 800 may be located adjacent to and in a same level or plane as entry aperture 765. An exit aperture 770 is located adjacent to head frame 605. Retaining member 800 may be formed as a rod, slot, or as a pulley and may be attached to an interior portion of body portion 710, as illustrated in FIGS. 16 and 17.

Retaining member 800 may be located at a substantially fixed distance from head frame 605, when mounted to window frame 650, to cause cord 610 to be maintained taut adjacent to front side 720 and/or flange 737. This may be accomplished through manufacturing window 670, window frame 650, and/or window covering control system 700 integrally. Alternatively, in the case of a retrofit of window covering control system 700 to an existing window and window frame, cord 610 may be severed and inserted into an exit aperture 770, movably connected to retaining member 800, and pulled out entry aperture 765. Severed ends of cord 610 might then be reattached to one another such that cord 610 is taut inside channel 750 and outside channel 750 adjacent to first side 720 and/or flange 737. The tautness may be achieved through one or both of positioning body portion 710 to cause positioning of retaining member 800 and adjusting a length of cord 610. Thus, reassembled cord 610 might be manipulated in a continuous loop to control window covering 600. Cord 610 might also be formed as a chain with removable links to allow easy reattachment of its ends after adjustment of cord 610 and mounting of body portion 710 to window frame 650.

Thus, about one-half of cord 610 is taut and enclosed in channel 750 and about another half is taut and located adjacent to front side 720 and/or flange 737 of body 710. There is no exposed loop at end 611 of cord 610, because end 611 is received by retaining member 800 and located partially or entirely inside channel 750. Therefore, there is reduced access to cord 610 resulting in less danger of being entangled therein. Particularly, there is less danger that a child might become entangled in end 611 of cords 610 and strangle himself therewith.

Figure 18:
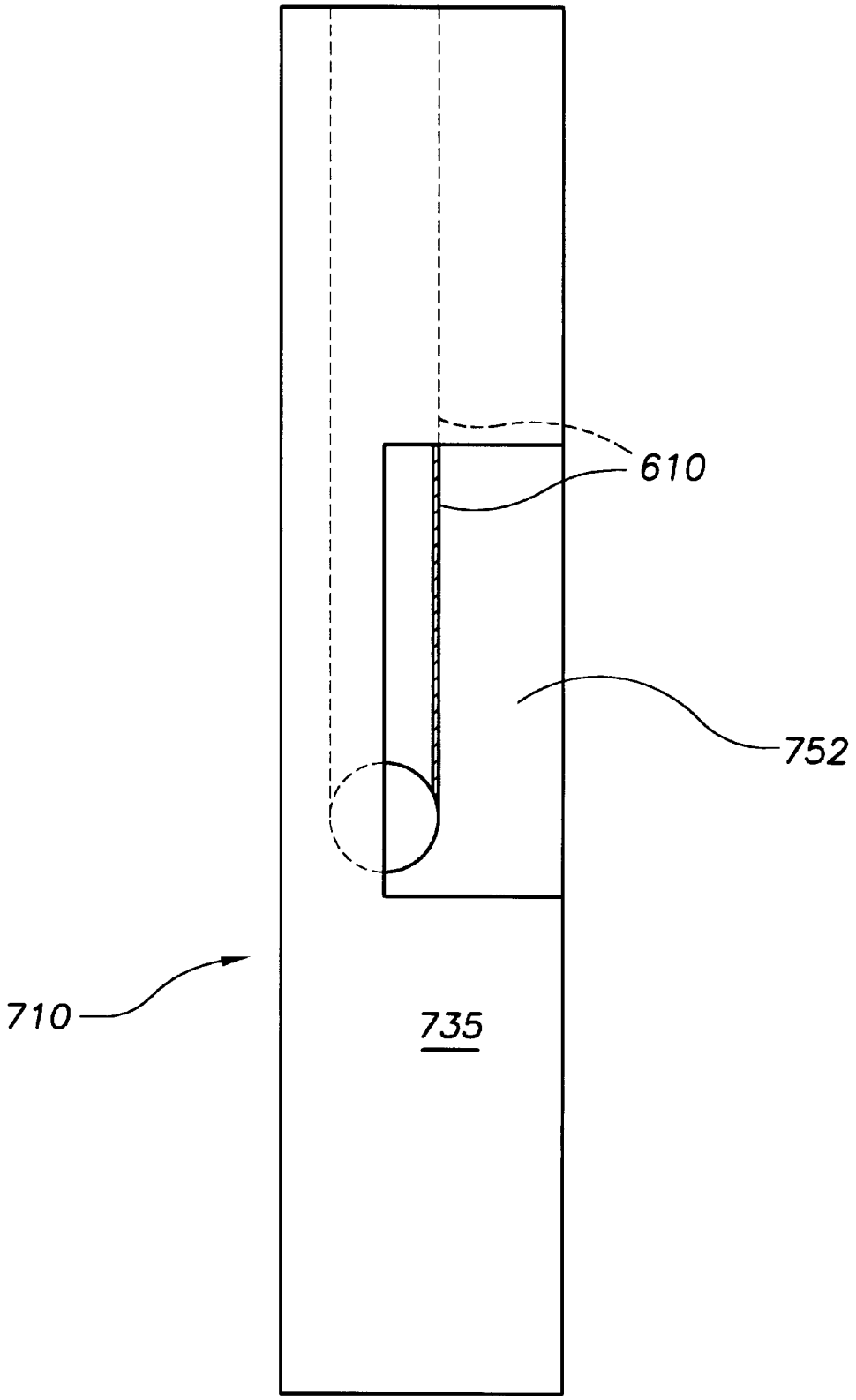
FIG. 18 is a right side elevational view of the system of FIG. 15.

Alternatively, right side 735 of body portion 710 might include an access aperture 752, as depicted in FIG. 18. Severed ends of cord 610 might be manipulated through access aperture 752 to facilitate moveable adjustment to retaining member 800 and/or reattachment of the severed ends to one another. When system 700 is mounted to window frame 650, exposure to access aperture 752 is reduced or eliminated since it abuts window frame 650.

Body portion 710 might also be formed having three sides instead of four wherein the fourth side is formed by window frame 650 on mounting of body 710 to window frame 650, as will be understood by those skilled in the art. In this embodiment, it is not necessary to sever cord 610 to allow entry thereof into channel 750. Instead, cords 610 might be movably attached to retaining member 800, for example a pulley, such that cord 610 remains taut, and body 710 might then be mounted to window frame 650 thus, maintaining cord 610 with minimal slack.

As will be appreciated by those skilled in the art, feature(s), characteristic(s), and/or advantage(s) of (e.g., portions of) the window covering control systems described herein, may be applied and/or extended to any embodiment (e.g., and/or portion thereof).

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A system for controlling a window covering device, said system comprising:

at least one cord for operating a window covering;

a body adapted for mounting adjacent to a window, said body comprising:

a vertically extending, elongate channel having top and bottom ends;

an entry aperture located in a side of said channel nearer said top end than said bottom end thereof with at least a portion of said cord extending into said channel through said entry aperture, an exposed portion of said cord being located outside of said channel and extending between said entry aperture and said top end;

a weight contained in said channel for slidable movement therealong between said entry opening and said bottom end and said weight being movably suspended from said cord so as to maintain an interior portion of said cord within said channel;

a free end of said cord being attached to said channel;

means on said body for fixedly mounting the body to a vertical surface adjacent a window;

whereby, said exposed portion of said cord may be accessed and moved by hand to operate the window covering while never extending below the entry aperture.

2. The system of claim 1 further comprising an exit aperture adapted for exit of an end of the at least one cord from said channel.

3. The system of claim 2 further comprising a stopper for attachment to the free end of the at least one cord.

4. The system of claim 3 wherein said stopper is adapted to maintain the end outside said channel.

5. The system of claim 2 wherein said entry aperture and said exit aperture are located about the same distance from the bottom end.

6. The system of claim 5 wherein said entry aperture and said exit aperture are adapted to be located about 62 inches from a floor.

7. The system of claim 1 further comprising a stopper and wherein said channel further comprises an exit aperture for exit of the at least one cord from said channel, wherein said channel receives the at least one cord through said entry aperture, wherein said weight receives the at least one cord, and wherein said stopper attaches to an end of the at least one cord outside said exit aperture.

8. The system of claim 1 wherein said body further comprises an access aperture adapted for insertion of said weight therethrough.

9. The system of claim 1 wherein said weight is adapted to draw at least a portion of the at least one cord into said channel.

10. The system of claim 1 wherein said weight further comprises a pulley adapted to receive the at least one cord.

11. The system of claim 1 wherein said weight is adapted to maintain the at least one cord adjacent to said body.

12. The system of claim 1 wherein said weight is adapted to maintain the at least one cord substantially taut.

13. The system of claim 1 further comprising a cord cover attached to said body.

14. The system of claim 13 further comprising a hollow portion between said body and said cord cover adapted to receive the at least one cord.

15. The system of claim 14 wherein said cord cover further comprises a slot sized to allow the at least one cord to pass therethrough into said hollow portion.

16. The system of claim 13 wherein a first end of said cord cover is located below said entry aperture and a second end of said cord cover is to be at least 72 inches from a floor adjacent to the window towards a headrail of the window covering device.

17. The system of claim 1 wherein said body is adapted for mounting to a window frame adjacent to the window.

18. The system of claim 1 further wherein said body is formed integral to a window frame adjacent to the window.

19. The system of claim 1 wherein the window covering device comprises a window blinds system.

* * * * *